United States Patent [19]

Jarrett et al.

[11] Patent Number: 4,737,247

[45] Date of Patent: Apr. 12, 1988

[54] INERT ANODE STABLE CATHODE ASSEMBLY

[75] Inventors: Noel Jarrett, Lower Burrell; Melvin H. Brown, Allegheny Township, Westmoreland County, both of Pa.

[73] Assignee: Aluminum Company of America, Pittsburgh, Pa.

[21] Appl. No.: 887,638

[22] Filed: Jul. 21, 1986

[51] Int. Cl.[4] ..... H01H 21/04; H01H 1/20

[52] U.S. Cl. ..... 204/67; 204/243 R; 204/286; 373/89; 373/90; 373/92

[58] Field of Search ..... 204/286, 67, 280, 288; 165/179; 373/37, 54–55, 89–90, 92

[56] References Cited

U.S. PATENT DOCUMENTS 3,745,106 9/1971 Jacobs ..... 204/243 R
3,772,201 11/1973 Mills ..... 204/277
3,960,678 6/1976 Alder ..... 204/64
3,974,046 8/1976 Alder ..... 204/67
4,333,803 6/1982 Seger et al. ..... 204/67

FOREIGN PATENT DOCUMENTS 3100921 8/1982 Fed. Rep. of Germany .

*Primary Examiner*—G. L. Kaplan
*Assistant Examiner*—Kathryn Rubino
*Attorney, Agent, or Firm*—Douglas G. Glantz

[57] ABSTRACT

This invention includes apparatus and method for providing a support mechanism for electrode assemblies including positioning spacer of electrically nonconductive material having an inside surface forming an internal cavity and a heat pipe for passing a heat transfer fluid through the cavity along the inside surface. The heat pipe transfers heat away from the positioning spacer to form a protective layer of frozen bath around the positioning spacer.

9 Claims, 1 Drawing Sheet

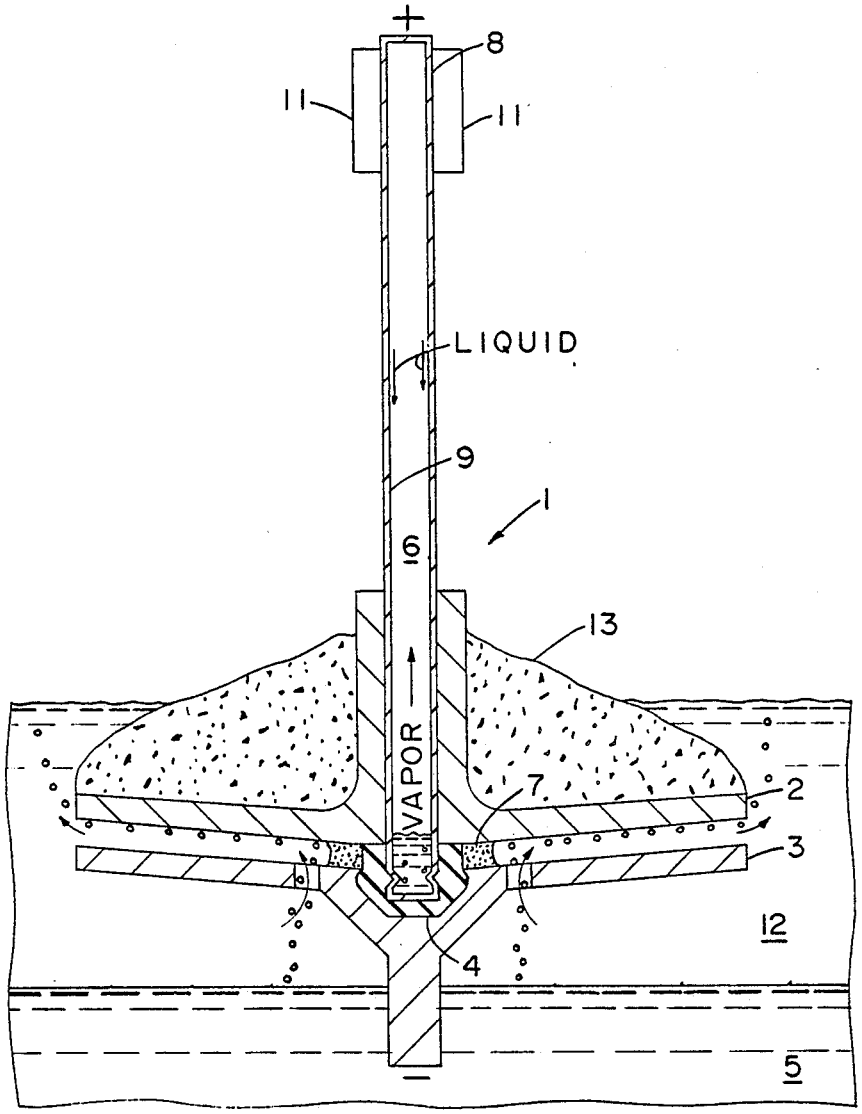
+
8
11
11
LIQUID
9
1
6
13
VAPOR
7
2
3
12
4
5
−

INERT ANODE STABLE CATHODE ASSEMBLY

BACKGROUND OF THE INVENTION

1. Technical Field

The present invention relates to apparatus and method for supporting and positioning inert electrodes in electrolytic reduction cells for the production of aluminum.

2. Description of Conventional Art

The electrolytic reduction smelting of aluminum involves an electrochemical oxidation and reduction reaction associated with the decomposition of alumina dissolved in cryolite electrolyte bath. The electrolyte bath in such a process is a fluoride-ion-containing molten metal solution which is very corrosive.

The production cells for the electrolytic smelting of aluminum according to the Hall-Heroult process have been the subject of novel electrode designs recently. For example, U.S. patent application Ser. No. 488,783, filed April 26, 1983, U.S. Pat. No. 4,664,760 by Noel Jarrett involves a novel electrolytic cell and method of electrolysis using supported electrodes. The Jarrett patent application addresses a significant problem which develops in standard commercial practice for producing aluminum, which is exemplified in fluoride-containing electrolyte bath electrolysis as in the Hall-Heroult process, when the electrode is supported by the floor or wall of the electrolytic cell. This problem derives from a warping of the internal surfaces of the cell, e.g., the floor or the wall, which occurs during the operation of the aluminum-producing cell under the normally harsh operating conditions of electrolytic smelting of alumina dissolved in cryolite electrolyte bath. Such warping will destroy a specified and particular electrode placement or positioning when the electrodes are fixed to or supported by the wall or floor of the cell. The Jarrett patent application provides a remedy for these problems by achieving and operating an electrolytic cell having a specified anode-cathode distance which can be maintained very small over a longer period of time than previously possible. In fact, the Jarrett invention provides an ability to establish an inter-electrode zone having a specified dimension which is essentially fixed.

However, there is a need for providing a spacer between the anode and cathode in a monopolar electrode assembly or between adjacent bipolar electrode surfaces in a bipolar electrode assembly in an electrolytic cell adapted to employ a specified anode-cathode distance.

It is an object of the present invention to provide a corrosion-resistant positioning means for electrodes immersed in a corrosive chemical bath, e.g., such as a fluoride-containing electrolyte bath in an aluminum smelting electrolysis cell.

It is a further object of the present invention to provide a spacer for positioning adjacent anode surfaces and cathode assemblies in monopolar and bipolar electrode assemblies to provide a specified anode-cathode distance and which will not be destroyed by the combinations of molten aluminum and fluoride-containing molten metal bath at the cathode and oxygen and fluoride-containing bath at the anode.

These and other objects of the present invention will become evident from the detailed description which follows.

SUMMARY OF THE INVENTION

The present invention involves apparatus and method for providing a support mechanism for electrode assemblies including positioning means of electrically nonconductive material having an inside surface forming an internal cavity and a heat pipe for passing a heat transfer fluid through the cavity along the inside surface. The heat pipe transfers heat away from the positioning means to form a protective layer of frozen bath around the positioning means.

The method of the present invention includes protecting an electrode positioning member from corrosive attack while immersed in a chemical bath, the positioning member being composed of an electrically nonconductive material and having an inside surface forming an internal cavity, which includes passing coolant through a heat pipe in the cavity along the inside surface to form a protective layer of frozen bath around the positioning member.

THE DRAWING

The sole FIGURE shows a schematic diagram of the corrosion-resistant support and spacer mechanism of the present invention.

DETAILED DESCRIPTION

A noncorrosive and electrically nonconductive support and positioning means is provided for positioning inert anode and inert cathode assemblies to form a specified anode-cathode distance in the electrolysis of alumina dissolved in cryolite electrolyte bath as used in the Hall-Heroult process. The support and positioning means of the present invention overcomes problems associated with the corrosive combinations of molten aluminum and fluoride-containing molten electrolyte bath at the cathode and oxygen and the electrolyte bath at the anode.

An inert electrically nonconductive material is essential for spacers in inert anode-inert cathode assemblies for electrolyzing alumina dissolved in Hall bath. Finding a spacer material that will not be attacked by the combinations of molten aluminum and Hall bath at the cathode and oxygen in the Hall bath at the anode may be difficult or even impossible. However, a solution to the problem is provided by the apparatus and process of the present invention. A spacer is provided having a hollow cavity through which a heat pipe coolant, such as potassium or sodium, could be passed to freeze the protective layer of bath around the spacer. A layer of frozen bath forming around the spacer protects the inert anode-inert cathode assembly from attack by the corrosive fluoride-containing molten salt bath of the typical Hall-Heroult electrolytic smelting cell for producing aluminum.

Referring now to the FIGURE, a monopolar electrode assembly 1 having inert anode 2 and inert cathode 3 is shown in schematic elevation. Positioning means including spacer 4 is disposed to provide a spacing function between the anodic surface and the cathodic surface of each of the aforementioned electrodes in the production of aluminum which collects in molten metal pad 5. The positioning means has a hollow cavity 6 through which a heat pipe is established having a coolant such as potassium or sodium. The cooling effect of heat pipe coolant flowing through the hollow cavity 6 has the effect of forming a frozen bath 7 around the spacing appendage 4 of overall positioning means of the present invention, i.e., including the cooling means of hollow cavity 6.

The invention includes using a heat pipe to form the protective layer of frozen bath 7 around the spacer 4. The heat pipe is used to enhance the heat transfer of the coolant flowing through the hollow cavity 6 out to the bath and provide a frozen bath around the spacer 4 in the positioning means of the present invention. Heat is transferred from the spacer 4 by applying heat pipe coolant including by the formation of potassium or sodium vapor which would rise in cavity 6 to the condensing section 8 at the top of the heat pipe where heat would be transferred to air or condensing liquid to form condensed potassium or sodium liquid. The condensed liquid potassium or sodium flows down the inside wall 9 of cavity 6 to complete the cycle. Fins 11 are added to condensing section 8 to enhance cooling and condensing of the heat pipe fluid.

In one aspect, the heat pipe of the present invention employs potassium as the heat pipe fluid. Potassium has a boiling point of about 760° C. Sodium can be used as a substitute for potassium. Sodium has a boiling point of about 880° C. However, potassium is the preferred heat pipe fluid in view of the operating temperature of the chemical bath 12 as shown in the FIGURE which typically is about 960° C.

Alumina 13 is provided on the top surface of anode 2 to protect against oxygen attack from oxygen rising through the chemical bath 12 from anode 2.

The heat pipe also permits the dual function of transferring both heat and electrical current.

While the invention has been described in terms of preferred embodiments, the claims appended hereto are intended to encompass all embodiments which fall within the spirit of the invention.

What is claimed is:

1. Corrosion-resistant positioning means for electrodes immersed in a chemical bath comprising:

(a) a spacer of electrically nonconductive material positioned between an anode and a cathode for providing a specified anode-cathode distance and having an inside surface forming an internal cavity;

(b) means for passing a heat transfer fluid through said cavity along said inside surface; and (c) a heat pipe for transferring heat away from said spacer.

2. Positioning means as set forth in claim 1, said heat pipe comprising a potassium or sodium heat pipe fluid for transferring heat away from said spacer.

3. Positioning means as set forth in claim 2 wherein said heat pipe transfers electrical current to said inert anode.

4. Positioning means as set forth in claim 3 wherein said heat pipe is capable of providing a protective layer of frozen bath on the outside surface of said spacer.

5. Positioning means as set forth in claim 4 wherein said chemical bath comprises cryolite.

6. Positioning means as set forth in claim 5 wherein said heat pipe comprises a potassium heat pipe fluid.

7. A method for positioning an anode and cathode and protecting an electrode positioning member from corrosive attack while immersed in a chemical bath, comprising:

(a) positioning an electrode positioning member between an anode and a cathode to form a specified anode-cathode distance, said positioning member having an inside surface forming an internal cavity;

(b) protecting said positioning member by forming a frozen layer of said chemical bath covering said positioning member by passing a coolant through said cavity along said inside surface; and (c) establishing a heat pipe in said cavity to enhance the heat transfer of said coolant flowing through said cavity.

8. A method as set forth in claim 7 wherein said chemical bath comprises cryolite and said coolant comprises potassium or sodium.

9. A method as set forth in claim 8 wherein said coolant consists essentially of potassium.

* * * * *

UNITED STATES PATENT AND TRADEMARK OFFICE

CERTIFICATE OF CORRECTION

PATENT NO. : 4,737,247

DATED : April 12, 1988

INVENTOR(S) : Noel Jarrett et al

It is certified that error appears in the above-identified patent and that said Letters Patent is hereby corrected as shown below:

Title page, References Cited

Change the issue date for U.S. Patent 3,745,106 from "9/1971" to --7/1973--.

For U.S. Patent 3,960,678, change the class from "204/64" to --204/67--.

Col. 4, line 11, Claim 3 — After "said" (2nd occurrence), delete "inert".

Signed and Sealed this

Twenty-seventh Day of September, 1988

*Attest:*

DONALD J. QUIGG

*Attesting Officer*

*Commissioner of Patents and Trademarks*